US006823998B2

(12) United States Patent
Fabregas

(10) Patent No.: US 6,823,998 B2
(45) Date of Patent: Nov. 30, 2004

(54) GARDEN CADDY

(76) Inventor: James E. Fabregas, 13217 NE. 54th Pl., Bellevue, WA (US) 98005

( * ) Notice: Subject to any disclaimer, the term of this patent is extended or adjusted under 35 U.S.C. 154(b) by 0 days.

(21) Appl. No.: 10/263,128

(22) Filed: Oct. 2, 2002

(65) Prior Publication Data

US 2004/0055979 A1 Mar. 25, 2004

Related U.S. Application Data

(60) Provisional application No. 60/412,226, filed on Sep. 20, 2002.

(51) Int. Cl.[7] ..... A47F 7/00

(52) U.S. Cl. ..... 211/70.6; 206/373

(58) Field of Search ..... 206/373; 211/70.6, 211/66, 65; 108/42, 47, 152; 248/210, 238

(56) References Cited

U.S. PATENT DOCUMENTS

| | | | | | |
|---|---|---|---|---|---|
| 1,593,834 | A | * | 7/1926 | McNeal et al. | 108/47 |
| 4,475,660 | A | | 10/1984 | Cain | 211/113 |
| 4,606,576 | A | * | 8/1986 | Jones | 297/153 |
| 4,706,918 | A | * | 11/1987 | Wilson | 248/210 |
| 4,867,332 | A | * | 9/1989 | Mains | 220/735 |
| 5,108,000 | A | | 4/1992 | Stoll et al. | 220/23.4 |
| 5,111,951 | A | | 5/1992 | Breen et al. | 220/23.4 |
| D332,854 | S | | 1/1993 | Waterston et al. | D34/1.11 |
| 5,211,294 | A | * | 5/1993 | Garman | 211/70.6 |
| 5,370,263 | A | * | 12/1994 | Brown | 206/373 |
| 5,573,081 | A | * | 11/1996 | Bartnicki et al. | 182/129 |
| 5,673,885 | A | * | 10/1997 | Pham | 248/210 |
| 5,697,512 | A | * | 12/1997 | Brickley | 220/23.8 |
| 5,799,795 | A | * | 9/1998 | Mease | 206/564 |
| 5,839,675 | A | * | 11/1998 | Henreckson et al. | 241/100 |
| 5,881,891 | A | | 3/1999 | Murphy, Jr. | 211/70.6 |
| 5,924,568 | A | * | 7/1999 | Zajonc | 206/373 |
| 5,988,542 | A | * | 11/1999 | Henreckson et al. | 241/100 |
| 6,059,109 | A | * | 5/2000 | Stein | 206/373 |
| 6,082,537 | A | * | 7/2000 | Quinn | 206/371 |
| 6,253,399 | B1 | | 7/2001 | Wagner | 5/507.1 |
| 6,311,841 | B1 | * | 11/2001 | Hodges | 206/541 |
| 6,564,941 | B2 | * | 5/2003 | Hedges | 206/373 |

* cited by examiner

*Primary Examiner*—Leslie A. Braun
*Assistant Examiner*—Khoa Tran
(74) *Attorney, Agent, or Firm*—Dean A. Craine

(57) ABSTRACT

A caddy for supporting and transporting cleaning and/or garden supplies or the like on the rim of a waste container. The caddy comprises a tray made of plastic or similar rigid material that attaches and extends laterally from the outer rim of a waste container. Formed on opposite sides of the tray is a concaved lip and a straight lip. Formed on the tray is a large, centrally aligned and downward extending cavity with concave and straight side walls that extend parallel to the concave and straight side walls on the tray. Slots are created between the lip and side walls of the cavity that are sufficiently wide to receive the curved or straight upper edges of a waste container. Formed around the cavity is a plurality of smaller holes or openings designed to hold such items as a cellular phone, a soda can, pliers, shears, small shovel, etc. At least two adjustable legs are attached to the bottom surface of the cavity that extend laterally in opposite directions to press against the outer surface of the waste container. During use, the caddy is placed on the outside edge of the waste container so that the large opening of the waste container is not blocked.

2 Claims, 3 Drawing Sheets

GARDEN CADDY

This Utility Patent Application claims the benefit of Provisional Patent Application (Ser. No. 60/412,226) filed on Sep. 20, 2002

BACKGROUND OF THE INVENTION

1. Field of the Invention

This invention relates to tool organizers, and more particularly, to tool organizers capable of mounting on the side of a waste receptacle.

2. Description of the Related Art

Gardening and other outdoor projects are as popular today as they were decades ago. In addition to the popular hobby of gardening or landscaping, craft projects are often performed outside, or small carpentry or automotive projects. It is necessary to keep a variety of small tools handy for easy access during any of these projects.

For example, a person may need to perform a variety of chores in the yard, such as weeding, watering, trimming hedges, and/or planting, most which require a waste receptacle and a variety of specific tools. Many people prefer to keep other personal comfort items with them, such as their cell phone and soft drink. As the yard worker moves from work site to work site within the yard, it can be quite awkward to keep track of and to transport all of these items with the user to avoid misplacement.

Waste containers are made of molded plastic and are available in different sizes and shapes, from approximately 7 gallon capacity to 64 gallon capacity. The outer shape of the waste container may be circular, square or rectangular. The upper, perimeter lip of the waste container also varies in size and thickness. The sides of the waste container are sloped inward so that they may be easily removed when molded. During use, the main opening of the waste container must be accessible so that large items, such as branches, leaves, etc. may be easily deposited therein.

What is needed is a horizontally aligned tray-type receptacle designed to hold a plurality of tools or other items laterally over different sizes of outer rims on circular or square waste containers that does not block the main opening to the waste container.

SUMMARY OF THE INVENTION

It is an object of the present invention to provide a garden caddy that is designed to attach to the upper rim of a circular or square waste container.

It is another object of the present invention to provide a garden caddy that attaches to the waste container's outer rim and extends laterally therefrom thereby keeping the main opening of the waste container open so that waste material may be easily deposited therein.

It is a further object of the present invention to provide a garden caddy that is adjustable for use with different sizes and shapes of waste containers.

These and other objects of the present invention are met by a caddy for supporting and transporting garden supplies and the like on the upper rim of a waste container. The caddy comprises a flat tray made of plastic or similar rigid material that attaches over and extends laterally from the upper rim of the waste container. Formed on the tray on opposite sides thereof is a concave-shaped, downward extending lip and a straight, downward extending lip. The tray includes a large, centrally located, downward extending cavity designed to hold garden tools, gloves and the like. The opposite side walls of the cavity are also concave and straight, and are parallel to the concave and straight, downward extending lips formed on the tray. The cavity is smaller in width than the tray so that the lips are spaced apart from the side walls of the cavity thereby forming curved and straight slots which receive the convex-shaped and straight upper rims of a waste container, respectively. Formed on the tray and around the cavity is a plurality of smaller, downward extending cavities designed to hold smaller objects such as a cellular telephone or soft drink. Also formed on the tray are optional smaller holes in which various narrow objects such as tool handles, screwdrivers, and the like may be inserted.

Attached to the bottom surface of the large cavity are at least two adjustable leg members that extend laterally from the bottom surface to press against the convex or straight sides of a waste container. During use, the length of the leg member is adjusted so that the tray may be horizontally aligned when attached to the waste container or other objects with sloped outer sides.

DESCRIPTION OF THE PREFERRED EMBODIMENT(S)

Figure 1:
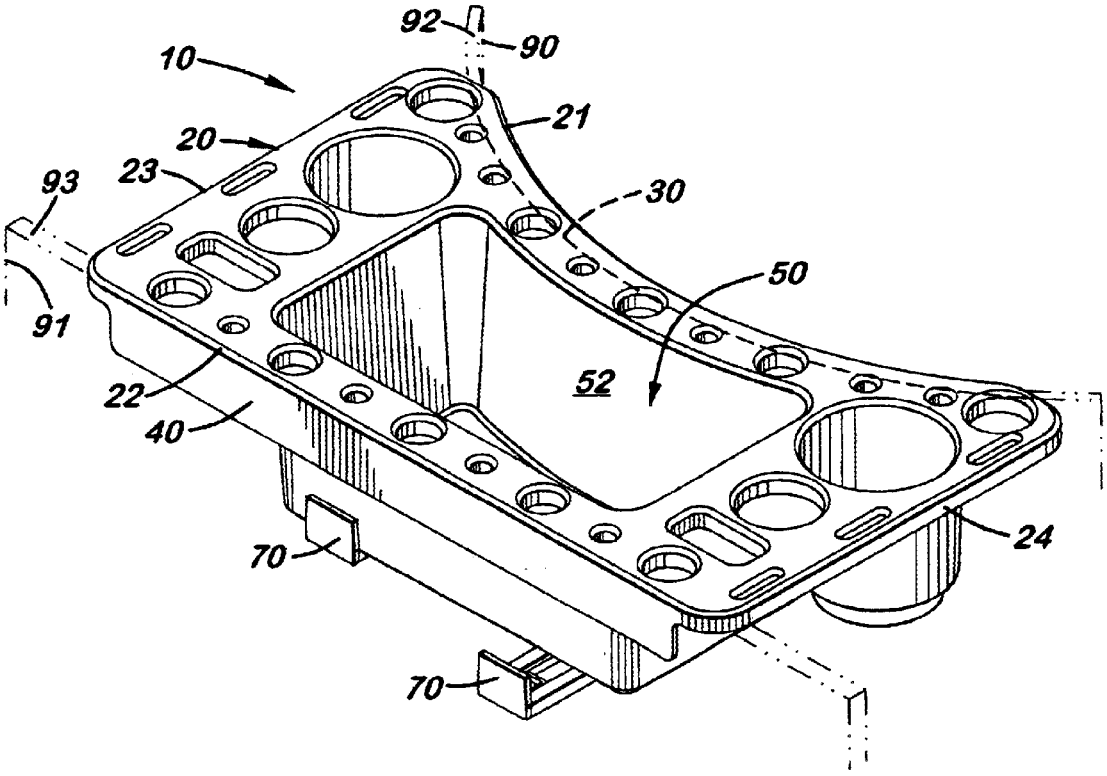
FIG. 1 is perspective view of the garden caddy disclosed herein.
Figure 2:
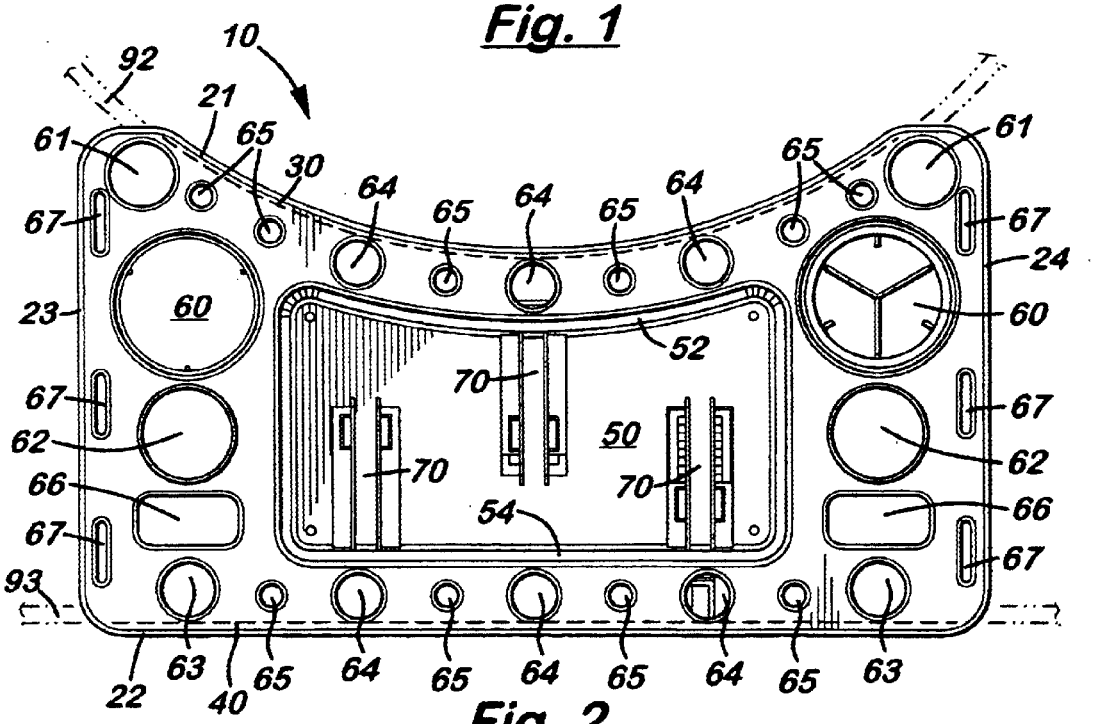
FIG. 2 is a top plan view of the invention.
Figure 3:
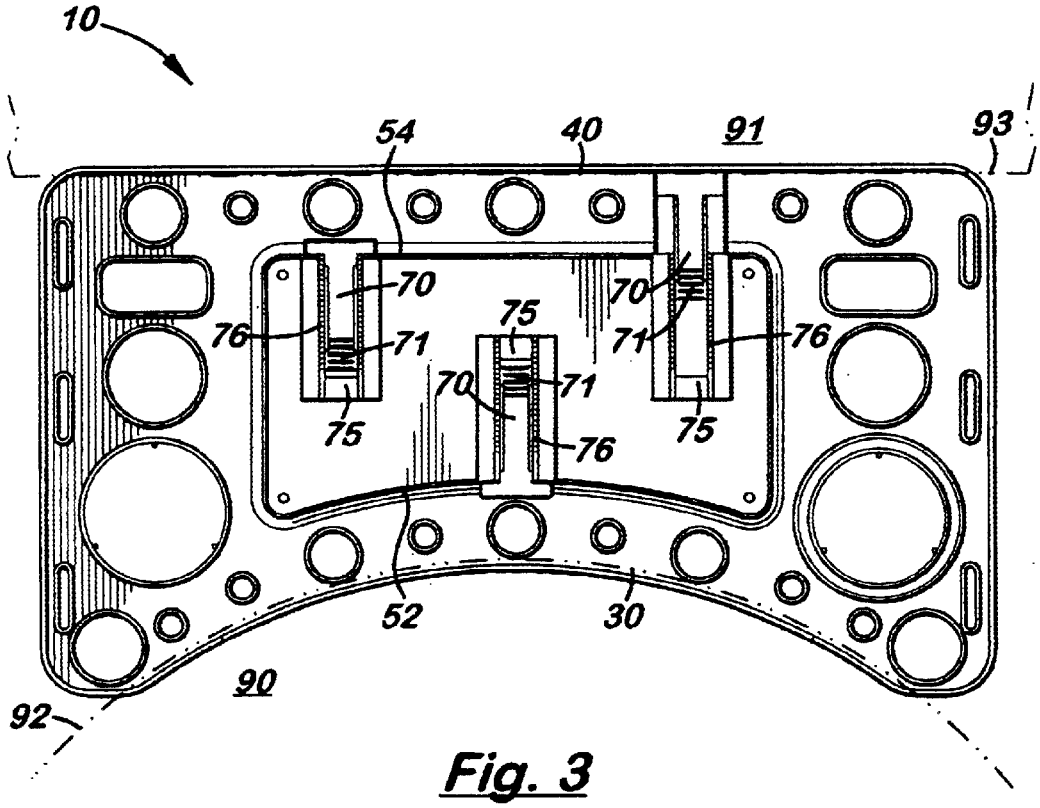
FIG. 3 is a bottom plan view of the invention.
Figure 4:
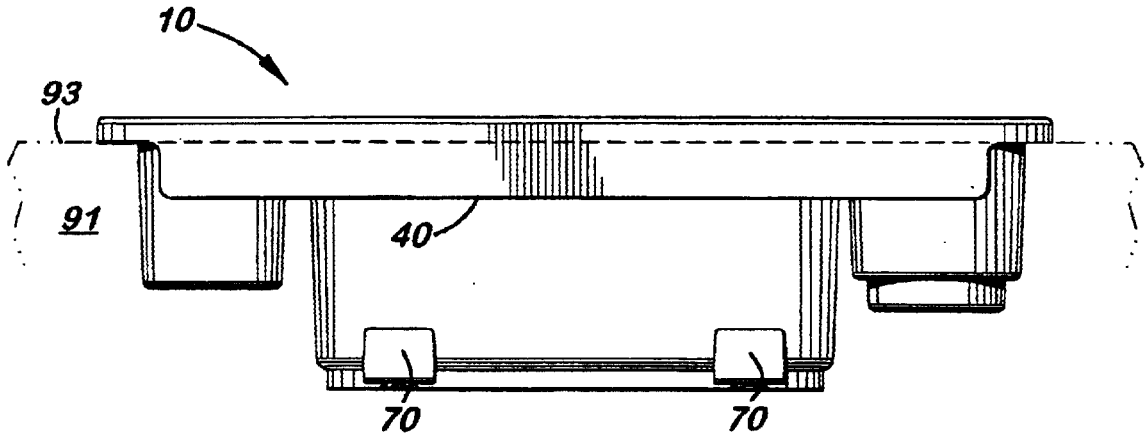
FIG. 4 is a rear elevational view of the invention.
Figure 5:
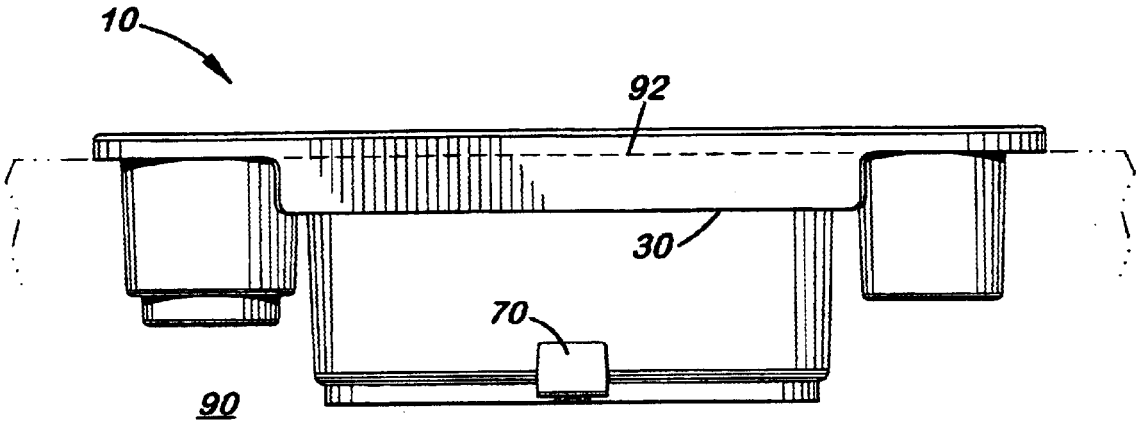
FIG. 5 is a front elevational view of the invention.
Figure 6:
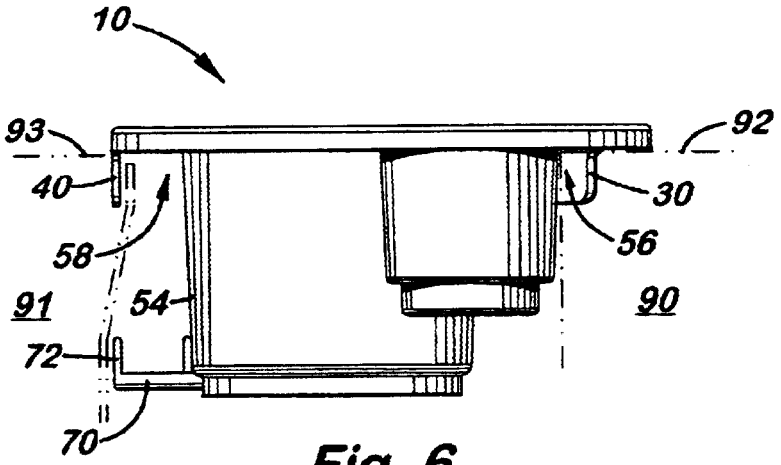
FIG. 6 is a right side elevational view of the invention.
Figure 7:
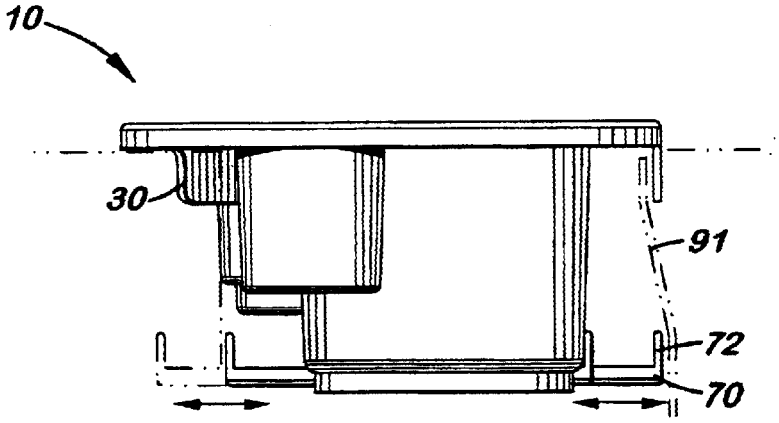
FIG. 7 is a left side elevational view of the invention.

In the accompanying FIGURES. there is shown and described a caddy 10 for supporting and transporting garden supplies or the like on the convex upper rim 92 or straight upper rim 93 of a round or straight-sided waste container 90, 91, respectively. The caddy 10 is comprised of a flat tray 20 made of plastic or similar rigid material that attaches to and extends laterally from either upper rim 92, 93 of a waste container 90, 91, respectively. The tray 20 includes a concave edge 21 and straight longitudinal edge 22 and two opposite straight end edges 23, 24. Formed on the concave edge 21 is a concave, downward-extending lip 30. Formed on the opposite, straight edge 22 of the tray 20 is a straight, downward extending lip 40.

In the preferred embodiment, the tray 20 includes a large, centrally located, downward extending cavity 50. The cavity 50 includes a concave-shaped side wall 52 aligned parallel with the sidewall of a waste container 90, and an opposite straight side wall 54 substantially parallel to the concave-shaped and straight lips 30, 40, respectively. The width of the cavity 50 is sufficient so that the side walls 52, 54 of the cavity 50 are spaced apart from the lips 30, 40, respectively to create a curved and straight slot 56, 58, respectively, designed to receive the convex or straight upper rims 92, 93, respectively, of a round or straight-sided waste container 90, 91, respectively.

Formed around the central cavity 50 is at least one large cup cavity 60 designed to hold a cellular telephone or soft drink. Also formed around the cavity 50 is a plurality of smaller circular and rectangular holes 61–66 in which various narrow objects may be inserted. Formed on the right and left side edges of the tray 20 is a plurality of narrow strap openings 67 designed to receive an optional strap (not shown).

Formed on the tray 20 is at least two adjustable leg members 70 that extend laterally to press against the curved or straight sides 94, 95, respectively, of the round or straight-sided waste container 90, 91, respectively to horizontally align the tray 20 thereon. In the preferred embodiment, there are three adjustable leg members 70 (two leg members 70 perpendicularly aligned with the concave edge 21 and one is perpendicularly aligned with the straight edge 22) attached to receivers 75 formed on the bottom surface of the central cavity 50. Each leg member 70 includes a plurality of teeth 71 which engage complementary-shaped teeth 76 formed on the receivers 75. During use, the length of the leg member 70 is adjusted on the receiver 75 so that the outer support surface 72 of the leg member 70 presses against the sides 94, 95 of the waste container 90 or 91. The teeth 71 and 76 are selectively engaged to lock the leg member 70 in a laterally extending, fixed position from the receiver 75.

In the preferred embodiment, the outer perimeter of the tray 20 measures approximately 20 inches in width and 11¼ inch in width. The radius of the concave lip 30 and the concave surface of the central cavity 50 is approximately 16 and 18 inches, respectively. The central cavity 50 is rectangular in shape with the convex-shaped side wall 52 and the straight side wall 54 each measuring approximately 11 inches in length, 5½ to 6 inches in width, and 5 inches in depth. The slots 56, 58 are approximately 1½ inches wide. The cup cavity 60 is approximately 3 to 3½ inches in diameter and 3½ to 4 inches in depth. The space between the straight and curved surfaces of the central cavity 50 is approximately 1¼ inches. Each of the plurality of smaller holes 61–66 is approximately ½ inch to 2 inches in diameter. The leg member 70 may be adjusted approximately 3½ inches.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A garden caddy for attachment to a round or straight-sided waste container, said caddy comprising:

a. a flat tray with at least one cup holder and a plurality of holes for holding tools;

b. a downward extending straight lip formed on one side of said tray;

c. a downward extending concave lip formed on one side of said tray opposite said straight lip;

d. a central cavity formed on said tray, said cavity including a concave side wall aligned and parallel to said concave lip on said tray and a straight side wall aligned and parallel to said straight lip on said tray, said concave side wall and said straight side wall being spaced apart from said concave lip and said straight lip, respectively, to create a curved and straight slot, respectively, for receiving the upper rim of a round or straight side waste container, said cavity including a bottom surface; and, e. means for adjustably aligning said tray in a level position on the round or straight-sided of a waste container.

2. The garden caddy, as recited in claim 1, wherein said means for adjustably aligning said tray is at least two adjustable legs attached to said bottom surface of said cavity that extend laterally in opposite directions from said tray, so that one said leg may be adjusted to and rest against the round or straight side of a waste container when the upper rim on the curved or straight side on the waste container is placed in said curved or straight slot.

* * * * *